US007793798B2

(12) United States Patent
Stradella et al.

(10) Patent No.: US 7,793,798 B2
(45) Date of Patent: Sep. 14, 2010

(54) DOSE INDICATOR FOR A FLUID DISPENSER DEVICE

(75) Inventors: Fabio Stradella, Camogli (IT); Giuseppe Stradella, Camogli (IT)

(73) Assignee: Valois S.A.S., Le Neubourg (FR)

( * ) Notice: Subject to any disclaimer, the term of this patent is extended or adjusted under 35 U.S.C. 154(b) by 1188 days.

(21) Appl. No.: 10/542,507

(22) PCT Filed: Jan. 19, 2004

(86) PCT No.: PCT/EP2004/000346

§ 371 (c)(1),
(2), (4) Date: Feb. 13, 2006

(87) PCT Pub. No.: WO2004/065910

PCT Pub. Date: Aug. 5, 2004

(65) Prior Publication Data

US 2006/0151524 A1 Jul. 13, 2006

(30) Foreign Application Priority Data

Jan. 20, 2003 (FR) ..... 03 00592

(51) Int. Cl.
*B67D 7/22* (2010.01)

(52) U.S. Cl. ..... 222/38; 222/162; 128/200.23; 128/200.24; 128/203.15; 128/205.23

(58) Field of Classification Search ..... 222/36, 222/38, 162; 128/200.23–200.24, 203.12, 128/203.15, 203.19, 203.21, 205.23
See application file for complete search history.

(56) References Cited

U.S. PATENT DOCUMENTS 5,020,527 A * 6/1991 Dessertine ..... 128/200.23
5,174,473 A * 12/1992 Marelli ..... 222/38
5,482,030 A * 1/1996 Klein ..... 128/200.23
6,164,494 A * 12/2000 Marelli ..... 222/38

FOREIGN PATENT DOCUMENTS

GB 1 336 014 A 11/1973
WO WO 96/39337 A 12/1996
WO WO 01/37909 A 5/2001

* cited by examiner

*Primary Examiner*—Kevin P Shaver
*Assistant Examiner*—Andrew P Bainbridge
(74) *Attorney, Agent, or Firm*—Sughrue Mion, PLLC

(57) ABSTRACT

A dose indicator for a fluid dispenser, the dose indicator includes at a minimum a ledge that actuates the dose indicator as the fluid dispenser device begins an actuation stroke that in turn actuates the first one of two flexible elements of the dose indicator that begins the actuation of a rotary counting wheel at the start of the actuation stroke of the fluid dispenser device, and the second less flexible element continues the actuation of the rotary counting wheel after the actuation stroke of the fluid dispenser device is completed. In some embodiments, the rotary counting wheel interacts with a display window with a groove and pin system to both rotate and translate the display window.

36 Claims, 4 Drawing Sheets

DOSE INDICATOR FOR A FLUID DISPENSER DEVICE

The present invention relates to a dose indicator, and to a fluid dispenser device including such an indicator.

In the field of fluid dispenser devices for dispensing several doses, and in particular in the field of sprays, numerous systems have been developed for indicating the number of doses dispensed or the number of doses still to be dispensed.

Most of those systems present numerous drawbacks. Thus, they are generally based on a plurality of toothed wheels forming gears, with the number of wheels depending on the quantity of doses to be counted. Consequently, the counters or indicators can become very complex, bulky, and therefore costly to manufacture and to assemble. In addition, numerals are generally used as indicators, and are often difficult for the user to read, in particular when the dispenser devices are designed to dispense a large number of doses, e.g. up to 200 doses. Furthermore, all current dose counter or indicator systems are unsuitable for use by the visually impaired, and in particular by the blind. Another major drawback resides in the fact that existing counters generally need an assembly procedure for assembling the dispenser device that is modified by the presence of the counter, and that therefore differs from the normal assembly procedure. This increases the complexity of the device, and consequently implies a higher cost.

An object of the present invention is to provide a dose indicator that is intended for a fluid dispenser device, and that does not have the above-mentioned drawbacks.

In particular, an object of the present invention is to provide a dose indicator which is simple and inexpensive to manufacture and to assemble, and which can, in particular, be applied to all existing fluid dispenser devices without implying a modification to the assembly procedure.

Another object of the present invention is to provide a dose indicator which is small, regardless of the number of doses contained in the dispenser device.

Another object of the present invention is to provide a dose indicator which forms a complete and separate unit, and which includes, in particular, the actuator means for actuating the indicator.

Another object of the present invention is to provide a dose indicator which can be read easily by the user, and which can also be used by the visually impaired, and in particular by the blind.

Another object of the present invention is to provide a dose indicator which avoids any risk of undercounting (failing to count a dose that has been dispensed). More particularly, an object of the present invention is to provide a dose indicator which counts during the first part of the actuation stroke of the dispenser device to which is it is associated.

The present invention therefore provides a dose indicator for a fluid dispenser device, said indicator being characterized in that it comprises a rotary counting wheel that is displaceable in rotation, and a slide member that is displaceable in translation, said counting wheel including indicator means, indicating the number of doses dispensed or the number of doses still to be dispensed, and co-operating with a display opening provided in said slide member, said rotary counting wheel including a hollow profile co-operating with a projection of said slide member, the shape of said hollow profile being such that at least some rotations of said rotary counting wheel cause said slide member to be displaced in translation, thereby modifying the position of said slide member relative to said counting wheel.

Advantageously, said indicator means follow said hollow profile at least in part.

Advantageously, the shape of said hollow profile is irregular so that dose indication is progressive.

Advantageously, said hollow profile is spiral-shaped at least in part.

Advantageously, said rotary counting wheel and said slide member are disposed in a cover including a display window co-operating with the display opening of the slide member.

Advantageously, said rotary counting wheel is a thin disk including a set of teeth, said set of teeth co-operating with actuator means which are designed to cause said rotary disk to turn.

Advantageously, said actuator means include a drive element secured to a ring surrounding said set of teeth, said drive element coming to co-operate with said set of teeth each time a dose is dispensed.

Advantageously, said ring includes anti-return means preventing said rotary disk from turning in the direction opposite to the direction in which it is turned by said drive element.

Advantageously, said actuator means include at least one flexible tab.

Advantageously, said actuator means include a transmission element which is designed to co-operate with said fluid dispenser device each time said device is actuated, said transmission element also co-operating with said drive element so as to cause said rotary disk to turn.

Advantageously, said transmission element is a shoulder secured to said drive element, and co-operating with a portion of the fluid dispenser device which moves during actuation.

Advantageously, the rotary counting wheel, the slide member, the actuator means, and the cover form a unit which can be assembled in a fluid dispenser device.

Advantageously, the actuator means include a flexible tab comprising a first flexible-tab portion and a second flexible-tab portion that is more rigid than the first tab portion, the first tab portion supporting an actuator pin which is designed to co-operate with the set of teeth of said rotary counting wheel each time the device is actuated.

Advantageously, said ring includes an abutment which is designed to co-operate with a blocking element secured to said flexible tab so as to limit the rotation of said rotary counting wheel.

Advantageously, the more rigid, second tab portion is designed to flex as soon as the blocking element is blocked by the abutment means of the ring.

Advantageously, the rotary counting wheel is rotated by the first part of the actuation stroke of the fluid dispenser device, the flexion of the more rigid, second tab portion enabling said actuation stroke of the fluid dispenser device to be continued, despite the blocking element being blocked by the abutment means.

Advantageously, said indicator means are numbers and/or symbols and/or colors.

The present invention also provides a fluid dispenser device, comprising a fluid reservoir and a dispenser member, such as a pump or a valve, mounted on said reservoir, and further comprising a dose indicator as defined above.

Advantageously, the dose indicator is actuated by a portion of the reservoir which is displaced while the device is being actuated, and which co-operates with a transmission element of said indicator.

Other characteristics and advantages of the present invention appear more clearly from the following detailed description of a particular embodiment thereof, given by way of non-limiting example, and with reference to the accompanying drawings, and in which.

The dose indicator A of the present invention applies to any type of fluid dispenser device. However, it applies more particularly to a spray, and advantageously to an aerosol, including a metering valve mounted on a receptacle containing a fluid for dispensing and a propellant gas.

Figure 1:
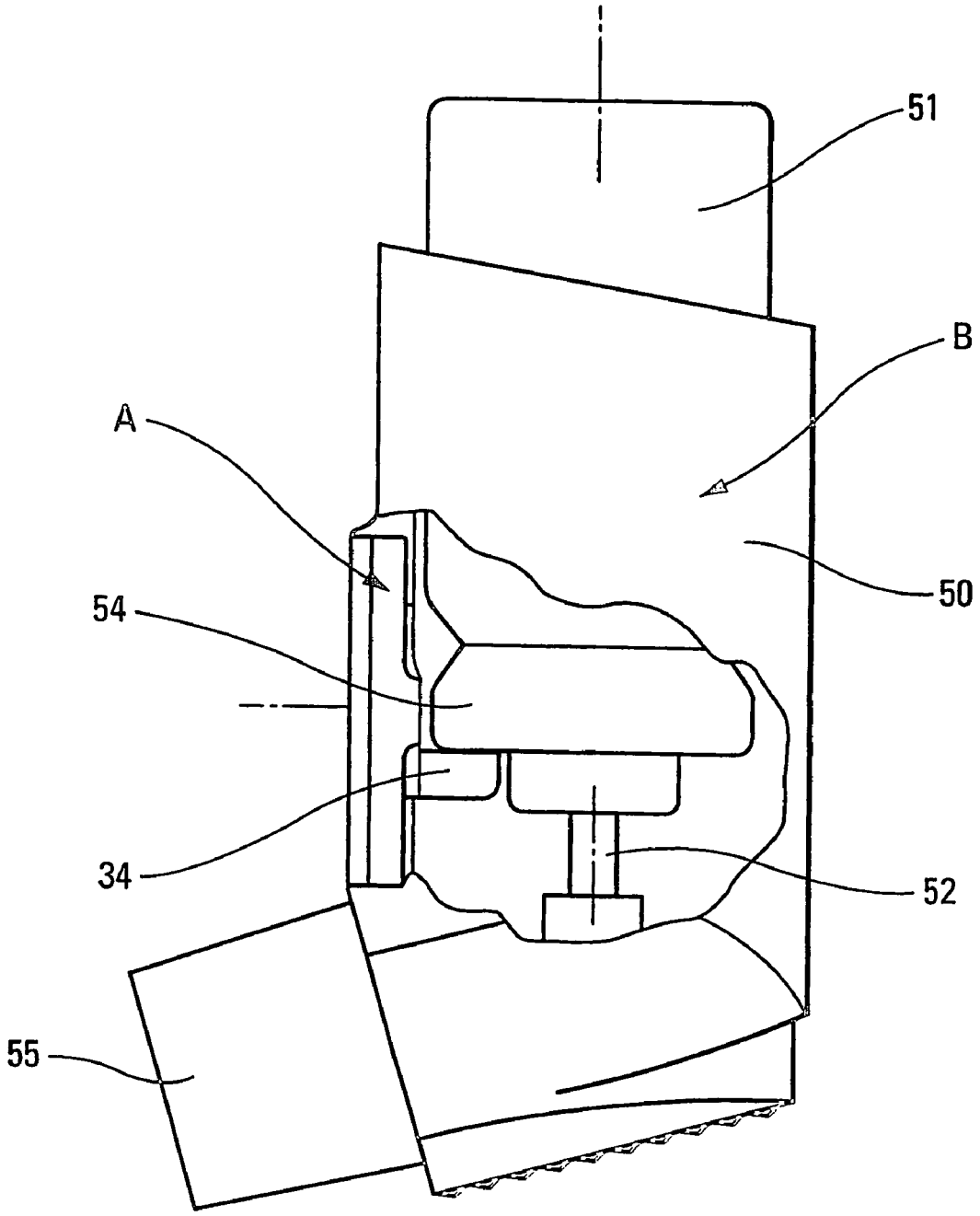
FIG. 1 is a partially cut-away diagrammatic side view of a fluid dispenser device including a dose indicator constituting an advantageous embodiment of the present invention.
Figure 2:
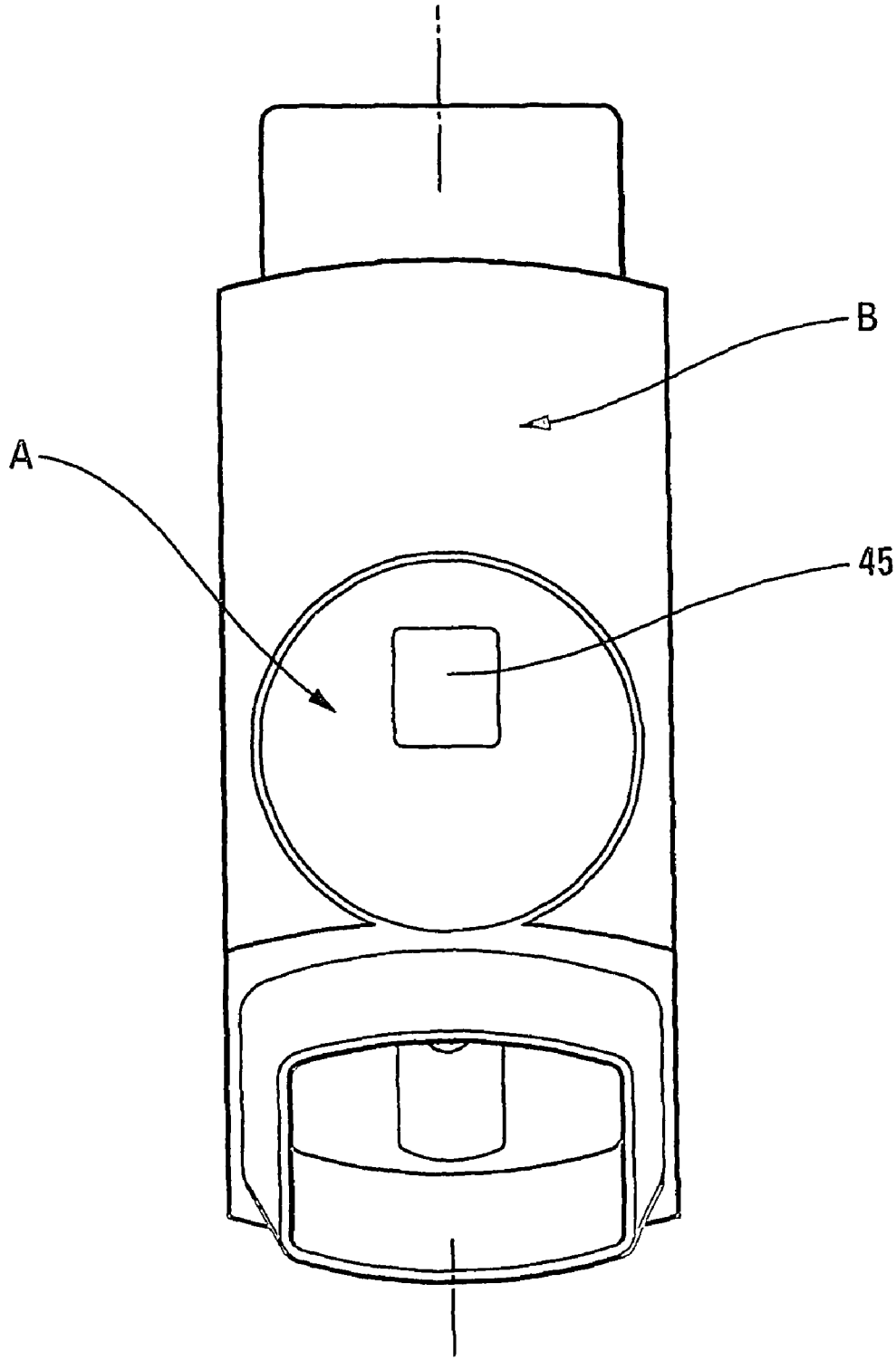
FIG. 2 is a front view similar to the FIG. 1 view.

FIGS. 1 and 2 diagrammatically show a dispenser device B to which the dose indicator A of the present invention is particularly adapted. The device comprises a body 50 and a reservoir 51 on which a metering valve 52 is assembled. The device B being actuated by axial displacement of the reservoir 51 inside the body 50, said displacement causing the rod of the valve 52 to be compressed, thereby causing a dose of substance to be expelled through the mouthpiece 55. Naturally, the present invention also applies to other types of dispenser device, and in particular to spray devices of the nasal type, or to devices including a pump instead of the valve.

FIGS. 3 to 10 show a dose indicator A, which can, in particular, be used with a fluid dispenser device B as described above. The dose indicator comprises a rotary counting wheel 10, preferably made in the form of a rotary disk, and designed to rotate about an axis of rotation that is substantially perpendicular to said disk 10. The rotary disk 10 is preferably thin, and is provided with a hollow profile 18 which can advantageously be formed by means of a rib. Advantageously, the disk 10 further comprises a set of teeth 19, preferably provided on its periphery, said set of teeth 19 being designed to co-operate with actuator means which are designed to cause said disk 10 to turn, and which are described in greater detail below. The disk or counting wheel 10 also comprises indicator means 15, which can be numbers and/or symbols and/or colors, and which are designed to indicate the number of doses dispensed or the number of doses still to be dispensed. The indicator means 15 advantageously follow said hollow profile 18 at least in part. Any combination of different indicator means 15 can also be envisaged.

The indicator A shown in the figures further comprises a slide member 20 which is designed to be displaced in translation. The slide member 20 includes a projection 28, or any other equivalent means, which co-operates with said hollow profile 18 of the rotary disk 10. The slide member 20 is preferably made in the form of a thin plate, and includes a display opening 25 which is designed to co-operate with the indicator means 15 of the rotary disk 10.

Figure 10:
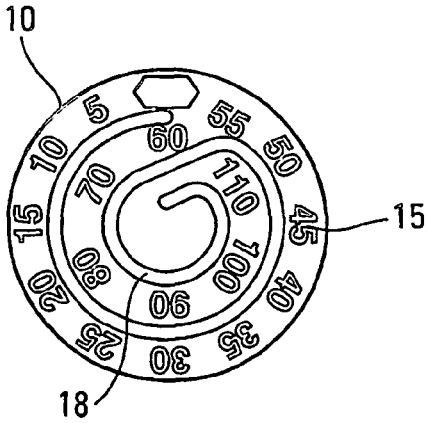
FIG. 10 is a diagrammatic view of a counting wheel constituting a variant embodiment of the invention.

Depending on the shape of the hollow profile 18, a rotation of the counting wheel 10 can cause the slide member 20 to be displaced in translation. The profile 18 is advantageously made so that indication is progressive and irregular. For example, the indicator in FIGS. 3 to 9 can count approximately 200 doses, with the last 50 being displayed by intervals of 5 in the display opening 25 of the slide member 20. In this embodiment, the hollow profile 18 is initially spiral-shaped, at the center of the disk 10, so that each rotation of said disk 10 causes said slide member 20 to be displaced in translation. When there are only 50 doses still to be dispensed, the profile 18 becomes cylindrical, so that subsequent rotations of the disk 10 no longer displace the slide member 20. The indicator numbers 15 are then displayed in the display opening 25 as the device is actuated. After the last dose, a specific symbol 17 can indicate that there are no doses left to be dispensed. FIG. 10 shows a variant embodiment in which the indicator can count 120 doses, with progressive indication taking place by intervals of 10 between the first and the $60^{th}$ dose, and by intervals of 5 thereafter. Other progressions can also be envisaged.

The counting wheel 10 and the slide member 20 are advantageously disposed in a cover 40 which is preferably also thin in structure, and which includes a display window 45 that co-operates with the display opening 25 of the slide member 20 so as to enable the user to see the indicator means 15 of the counting wheel 10.

The indicator A, and in particular the rotary counting wheel 10, can advantageously be actuated by actuator means integrated in said indicator A. Thus, with reference to FIGS. 3 to 10, the actuator means can advantageously include a drive element 31 secured to a ring 30 which surrounds said set of teeth 19 of the rotary disk 10. The drive element 31 is designed to co-operate with said set of teeth 19 each time a dose is dispensed, and preferably by means of an actuator pin 35. Anti-return means 36, 37 are advantageously provided so as to prevent said rotary disk 10 from turning in the direction opposite to the direction in which it is turned by the drive element 31 during actuation. The anti-return means can comprise a flexible tab 36 that supports an anti-return pin 37 that co-operates with the set of teeth 19.

The actuator means also advantageously include a transmission element 34 which is designed to co-operate with the fluid dispenser device B on each actuation, said transmission element 34 also co-operating with said drive element 31 so as to cause said rotary disk 10 to turn. In particular, and as shown in particular in FIG. 1, said transmission element 34 is a shoulder that is secured to the drive element 31, and that co-operates with a portion 54 of the fluid dispenser device B which moves during actuation. In the embodiment shown, said portion 54 is the fixing ring for fixing the metering valve 52 onto the reservoir 51. Naturally, and more generally, any portion which is displaced while the device B is being actuated, is suitable for co-operating with the shoulder 34 so as to actuate the dose indicator A.

Figure 3:
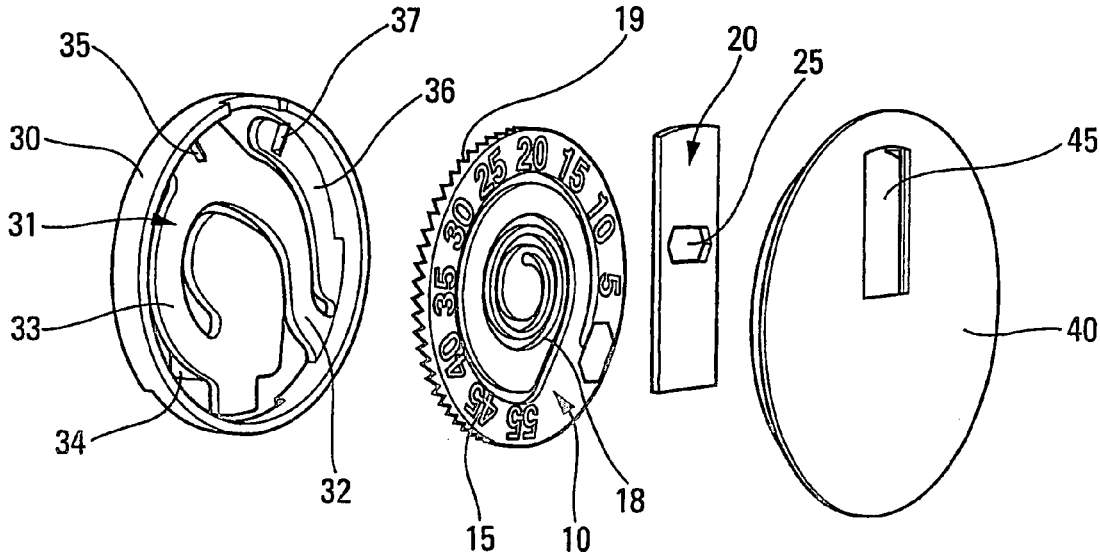
FIG. 3 is an exploded view of a dose indicator constituting an advantageous embodiment of the invention.
Figure 4:
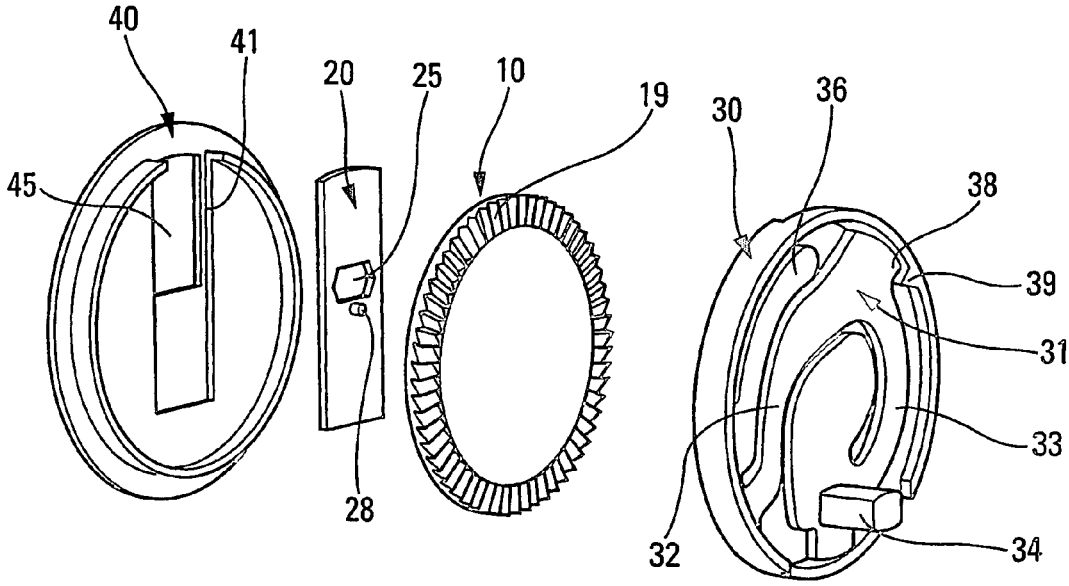
FIG. 4 is a view similar to the FIG. 3 view, seen from a different angle.
Figure 5:
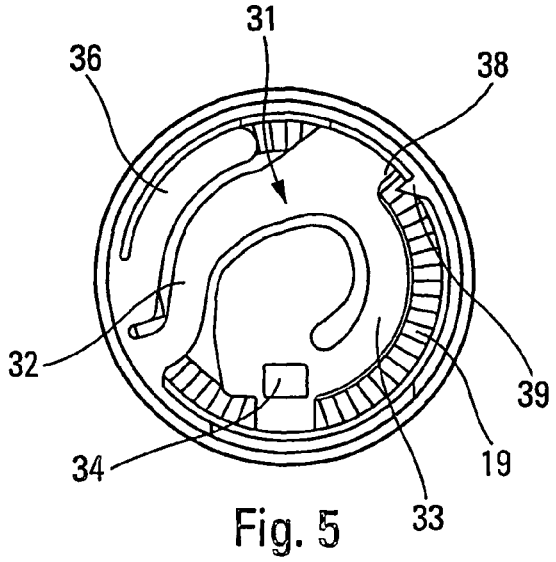
FIG. 5 is a diagrammatic rear view of the indicator in FIGS. 3 and 4.
Figure 6:
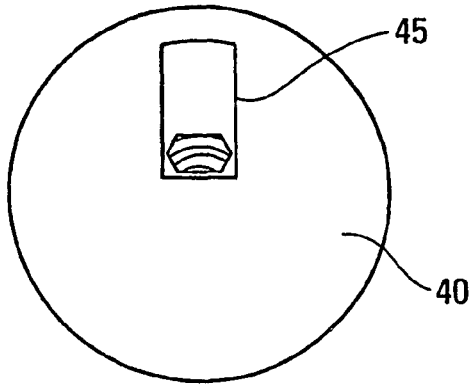
FIG. 6 is a diagrammatic front view of the indicator in FIGS. 3 and 4.
Figure 7:
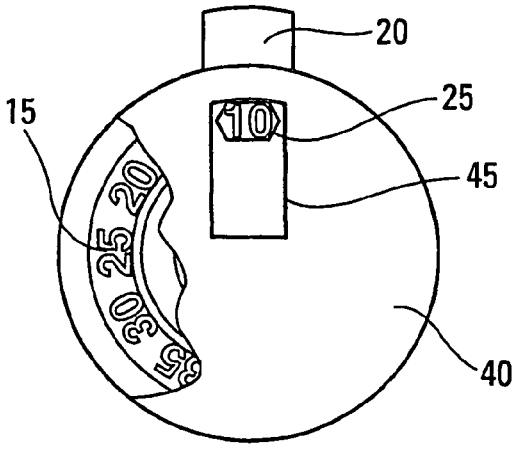
FIG. 7 is a partially cut-away diagrammatic view, showing the counter with 10 doses remaining.
Figure 8:
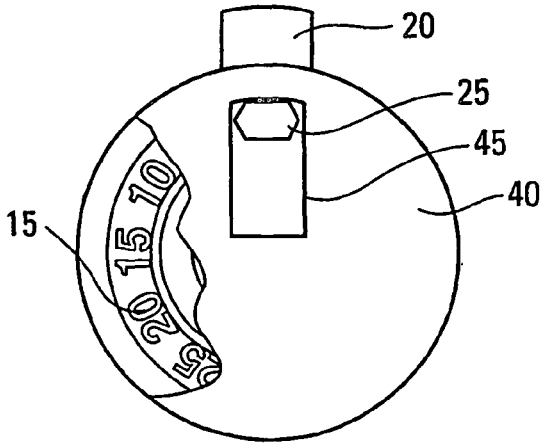
FIG. 8 is a view similar to the FIG. 7 view, showing the counter with no doses remaining.
Figure 9:
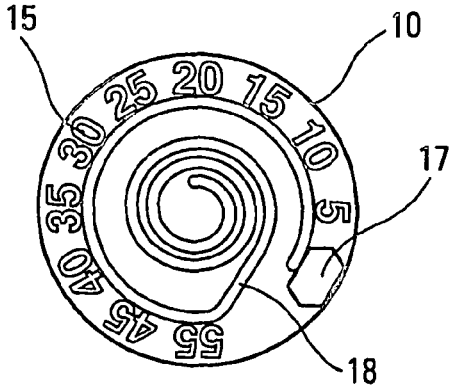
FIG. 9 is a diagrammatic view of the counting wheel in FIGS. 3 to 8.

With reference to FIGS. 3 to 5, the actuator means can include at least one flexible tab 31 forming the drive element, said flexible tab 31 can be provided with two flexible portions 32 and 33 of different flexibilities, the portion 32 being more flexible than the portion 33. For example, the portion 33 is wider than the portion 32. The flexible tab 31 supports said shoulder 34, and when the spray device B is actuated, the fixing ring 54 of the reservoir initially causes the more flexible portion 32 of the arm 31 to flex parallel to the rotary disk 10, thereby causing said disk 10 to turn by drive from the actuator pin 35 which co-operates with the set of teeth 19. The flexible tab 31 advantageously includes a blocking element 38 which is designed to co-operate with a projecting abutment 39 secured to the ring 30. The radial distance between the blocking element 38 and the abutment 39 advantageously corresponds to a tooth of the set of teeth 19. Thus, during actuation, the shoulder 34 is displaced (downwards in the figures) by the dispenser device B, and the more flexible arm portion 32 flexes (also downwards in the figures) until the blocking element 38 comes into contact with the abutment 39. This causes the counting wheel 10 to rotate over the equivalent of a tooth. The more flexible arm portion 32 is thus blocked, and it is possible for the actuation stoke of the dispenser device B to continue by means of the less flexible arm portion 33 flexing. In this way, the dose indicator can be actuated in the first portion of said actuation stroke. This eliminates any risk of a dose that has been dispensed (partially or completely) not being counted, in the event of the dispenser device B being partially actuated, while enabling the actuation stroke to continue after counting. The abutment 39 and the anti-return means 36, 37 ensure that each dose is only counted once.

The cover 40 advantageously includes guide means 41, such as rails or ribs, which co-operate with the slide member 20 so as to guide it in its displacement in translation.

The number of teeth on the set of teeth 19 and the shape of the hollow profile 18 of the counting wheel 10 therefore give the characteristics of the dose indicator, and in particular, the number of doses that the indicator can count. Thus, in the embodiment shown in FIGS. 3 to 9, a dose indicator is shown which is designed to count approximately 200 doses, with the last 50 being displayed numerically by intervals of 5 in the display opening 25 of the slide member. Naturally, the maximum number of doses and the display method can be varied as required by modifying the structure of the profile 18, the indicator means, or the number of teeth in the set of teeth 19. The present invention therefore makes it possible to produce dose indicators which are designed to count any number of doses without modifying the shape or the size of said indicator. As mentioned above, the dimensional structure of the present indicator is particularly small, in particular in terms of thickness, and the indicator A can therefore be integrated very easily into existing fluid dispenser devices B, as shown in FIGS. 1 and 2.

The dose indicator of the present invention makes it possible, in simple, inexpensive, and progressive manner, to display the number of doses dispensed or the number of doses still to be dispensed from the device. The structure of the indicator is very thin, regardless of the number of doses that it needs to indicate, and it does not include any projecting portion that implies modifications need to be made to the device to which it is applied. As shown in FIG. 1, the dose indicator A of the present invention is applied very easily to any existing device, without said devices needing to be modified. The presence of the indicator A also does not require the assembly process for assembling the device B to be modified. By way of example, the indicator can be put in place in the device B via an opening provided for this purpose on the front portion of the body 50 of the device. Another advantage of the indicator of the present invention is that the actuator means of the indicator are integrated therein, so that the indicator forms an autonomous and separate unit which can be pre-assembled and can easily be integrated into any fluid dispenser device.

Naturally, the present invention is described above with reference to a particular embodiment thereof shown in the drawings, but it is not in any way limited to that particular embodiment. On the contrary, any modifications could be applied thereto by a person skilled in the art, without going beyond the ambit of the present invention as defined by the accompanying claims.

The invention claimed is:

1. A dose indicator (A) for a fluid dispenser device (B), said dose indicator being characterized in that it comprises a rotary counting wheel (10) that is displaceable in rotation, and a slide member (20) that is displaceable in translation, said rotary counting wheel including indicator means (15) for indicating the number of doses dispensed or the number of doses still to be dispensed, and cooperating with a display opening (25) provided in said slide member (20), said rotary counting wheel (10) including a hollow profile (18) co-operating with a projection (28) of said slide member (20), the shape of said hollow profile (18) being such that at least some rotations of said rotary counting wheel (10) causes said slide member (20) to be displaced in translation, thereby modifying the position of said slide member (20) relative to said counting wheel (10), and in that the dose indicator further comprises actuator means for displacing said rotary wheel, said actuator means comprising two flexible elements (32, 33) of different flexibilities, the more flexible element (32) enabling said rotary counting wheel (10) to be rotated at a start of an actuation stroke of the actuator means, and the less flexible element (33) enabling said actuation stroke to be continued after said counting wheel (10) has been rotated.

2. The dose indicator according to claim 1, in which said indicator means (15) follow said hollow profile (18) at least in part.

3. The dose indicator according to claim 1, in which the shape of said hollow profile (18) is irregular so that dose indication is progressive.

4. The dose indicator according to claim 1, in which said hollow profile (18) is spiral-shaped at least in part.

5. The dose indicator according to claim 1, in which said rotary counting wheel (10) and said slide member (20) are disposed in a cover (40) including a display window (45) co-operating with the display opening (25) of the slide member (20).

6. The dose indicator according to claim 1, in which said rotary counting wheel (10) is a thin disk including a set of teeth (19), said set of teeth (19) cooperating with actuator means which are designed to cause said rotary disk (10) to turn.

7. The dose indicator according to claim 6, in which said actuator means include a drive element (31) secured to a ring (30) surrounding said set of teeth (19), said drive element (31) coming to co-operate with said set of teeth (19) each time a dose is dispensed.

8. The dose indicator according to claim 7, in which said ring (30) includes anti-return means (36, 37) preventing said rotary disk (10) from turning in the direction opposite to the direction in which it is turned by said drive element (31).

9. The dose indicator according to claim 7, in which said actuator means include at least one flexible tab (31).

10. The dose indicator according to claim 7, in which said actuator means include a transmission element (34) which is designed to co-operate with said fluid dispenser device (B) each time said device is actuated, said transmission element (34) also cooperating with said drive element (31) so as to cause said rotary disk (10) to turn.

11. The dose indicator according to claim 10, in which said transmission element (34) is a shoulder secured to said drive element (31), and co-operating with a portion (54) of the fluid dispenser device (B) which moves during actuation.

12. The dose indicator according to claim 5, in which the rotary counting wheel (10), the slide member (20), the actuator means (31, 34, 35), and the cover (40) form a unit which can be assembled in a fluid dispenser device (B).

13. The dose indicator according to claim 1, in which the actuator means include a flexible tab (31) comprising a first flexible-tab portion (32) and a second flexible-tab portion (33) that is more rigid than the first tab portion (32), the first tab portion (32) supporting an actuator pin (35) which is designed to cooperate with the set of teeth (19) of said rotary counting wheel (10) each time the device is actuated.

14. The dose indicator according to claim 13, in which said ring (30) includes an abutment (39) which is designed to co-operate with a blocking element (38) secured to said flexible tab (31) so as to limit the rotation of said rotary counting wheel (10).

15. The dose indicator according to claim 14, in which the more rigid, second tab portion (33) is designed to flex as soon as the blocking element (38) is blocked by the abutment means (39) of the ring (30).

16. The dose indicator according to claim 13, in which the rotary counting wheel (10) is rotated by the first part of the actuation stroke of the fluid dispenser device (B), the flexion of the more rigid, second tab portion enabling said actuation stroke of the fluid dispenser device (B) to be continued, despite the blocking element (38) being blocked by the abutment means (39).

17. The dose indicator according to claim 1, in which said indicator means (15) are numbers and/or symbols and/or colors.

18. A fluid dispenser device (B), comprising a fluid reservoir (51) and a dispenser member (52), such as a pump or a valve, mounted on said reservoir (51), said device being characterized in that it further comprises a dose indicator (A) according to claim 1.

19. A device according to claim 18, in which the dose indicator (A) is actuated by a portion (54) of the reservoir (51) which is displaced while the device (B) is being actuated, and which co-operates with a transmission element (34) of said indicator (A).

20. A dose indicator for a fluid dispenser device, wherein said dose indicator comprises a rotary wheel that is displaceable in rotation, the indicator further comprising actuator means for displacing said rotary wheel, said actuator means comprising two flexible elements of different flexibilities, the more flexible element enabling said rotary wheel to be rotated at a start of an actuation stroke of the actuator means, and the less flexible element enabling said actuation stroke to be continued after said rotary wheel has been rotated.

21. The dose indicator according to claim 20, in which said rotary wheel is disposed in a cover comprising a display window.

22. The dose indicator according to claim 20, in which said rotary wheel is a thin disk comprising a set of teeth, said set of teeth cooperating with the actuator means which are designed to cause said rotary wheel to turn.

23. The dose indicator according to claim 22, in which said actuator means comprises a drive element secured to a ring surrounding said set of teeth, said drive element co-operating with said set of teeth each time a dose is dispensed.

24. The dose indicator according to claim 23, in which said ring comprises anti-return means preventing said rotary wheel from turning in a direction opposite to the direction in which said rotary wheel is turned by said drive element.

25. The dose indicator according to claim 23, in which said actuator means comprises at least one flexible tab.

26. The dose indicator according to claim 23, in which said actuator means comprises a transmission element that cooperates with said fluid dispenser device each time said device is actuated, said transmission element also cooperating with said drive element so as to cause said rotary wheel to turn.

27. The dose indicator according to claim 26, in which said transmission element is a shoulder secured to said drive element and cooperating with a portion of the fluid dispenser device which moves during actuation.

28. The dose indicator according to claim 21, in which the rotary wheel, the actuator means, and the cover form a unit configured to be assembled in a fluid dispenser device.

29. The dose indicator according to claim 20, in which the actuator means comprises a flexible tab comprising a first flexible-tab portion and a second flexible-tab portion that is more rigid than the first tab portion, the first tab portion supporting an actuator pin that cooperates with a set of teeth of said rotary wheel each time the device is actuated.

30. The dose indicator according to claim 29, in which said ring comprises an abutment that cooperates with a blocking element secured to said flexible tab so as to limit the rotation of said rotary wheel.

31. The dose indicator according to claim 30, in which the more rigid, second tab portion is designed to flex as soon as the blocking element is blocked by the abutment of the ring.

32. The dose indicator according to claim 29, in which the rotary wheel is rotated by a first part of the actuation stroke of the fluid dispenser device, the flexion of the more rigid, second tab portion enabling said actuation stroke of the fluid dispenser device to be continued, despite the blocking element being blocked by the abutment.

33. A fluid dispenser device, comprising a fluid reservoir and a dispenser member mounted on said reservoir, said device further comprising a dose indicator according to claim 20.

34. A device according to claim 33, in which the dose indicator is actuated by a portion of the reservoir which is displaced while the device is being actuated and which co-operates with a transmission element of said indicator.

35. A dose indicator for a fluid dispenser device, wherein the dose indicator comprises:

a rotary wheel that is displaceable in rotation;

an actuator comprising a first flexible element and a second flexible element, wherein the first flexible element is more flexible than the second flexible element, the actuator further comprising a movable transmission element configured to engage a dispenser device; and wherein initial movement of the movable transmission element causes the first flexible element to flex and rotate the rotary wheel by a predetermined amount before the first flexible element is stopped and thereafter the second flexible element to flex so as to allow continued movement of the movable transmission element.

36. The dose indicator according to claim 35, wherein the rotary wheel comprises teeth and the first flexible element is attached to an engagement pin that engages the teeth to rotate the rotary wheel in one direction when the first flexible element is flexed.

* * * * *